United States Patent [19]

Drummond

[11] 4,024,700

[45] May 24, 1977

[54] BULKY YARN

[75] Inventor: Warren W. Drummond, Allison Park, Pa.

[73] Assignee: PPG Industries, Inc., Pittsburgh, Pa.

[22] Filed: Apr. 6, 1976

[21] Appl. No.: 674,242

Related U.S. Application Data

[60] Continuation-in-part of Ser. No. 569,326, April 17, 1975, abandoned, which is a division of Ser. No. 452,106, March 18, 1974, Pat. No. 3,918,244.

[52] U.S. Cl. ..... 57/144; 57/140 G

[51] Int. Cl.[2] ..... D02G 3/18

[58] Field of Search ..... 57/140 G, 144, 139, 57/140 R, 160

[56] References Cited

UNITED STATES PATENTS

| | | | |
|---|---|---|---|
| 3,410,077 | 11/1968 | Marzocchi et al. | 57/144 |
| 3,605,397 | 9/1971 | Irwin et al. | 57/140 G |

*Primary Examiner*—Donald Watkins

*Attorney, Agent, or Firm*—Alan T. McDonald; John E. Curley

[57] ABSTRACT

A bulky yarn is disclosed having a low bulk density which comprises a spun ribbon of filaments or groups of filaments which may additionally be combined with a core strand. The spun continuous filaments form a plurality of loops which tangle with each other and with the core, if employed, to produce a continuous yarn having the appearance of a spun staple yarn.

4 Claims, 8 Drawing Figures

FIG. 3
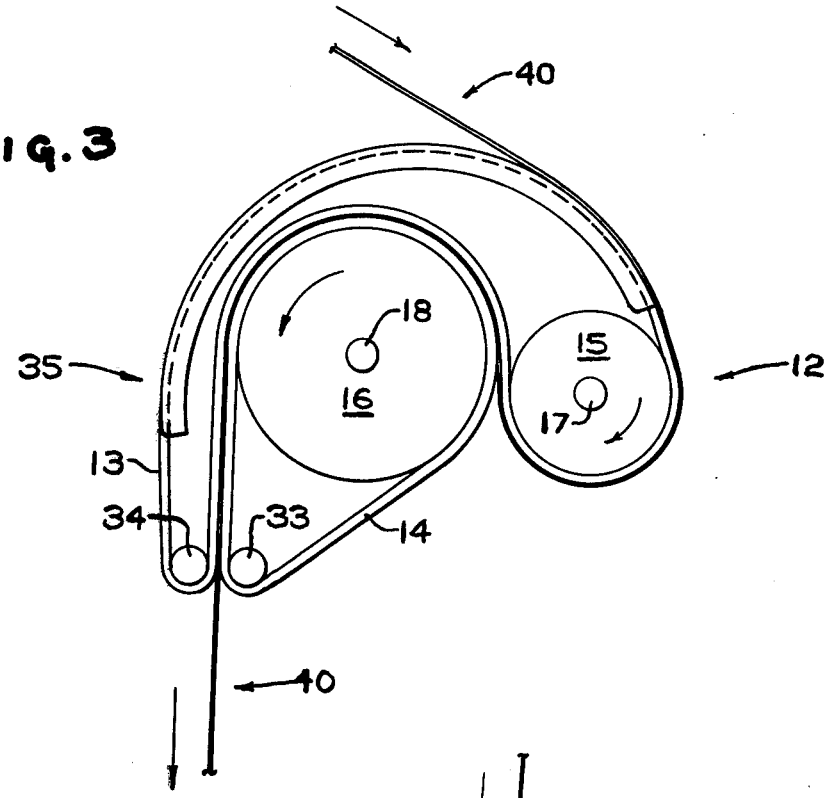
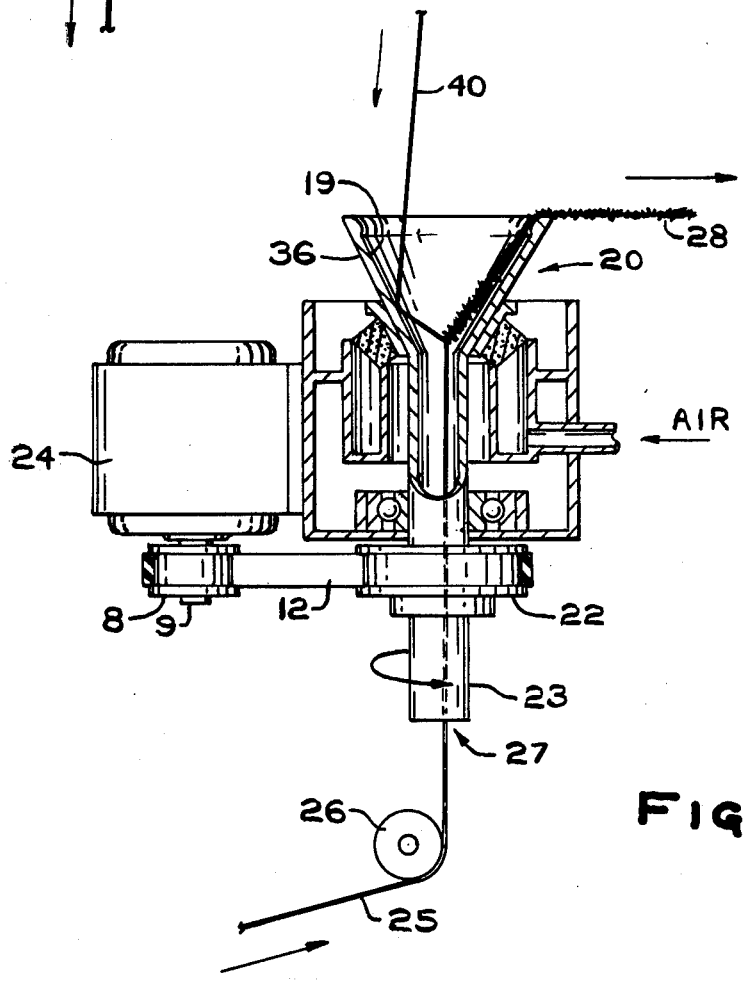
FIG. 4

FIG. 5
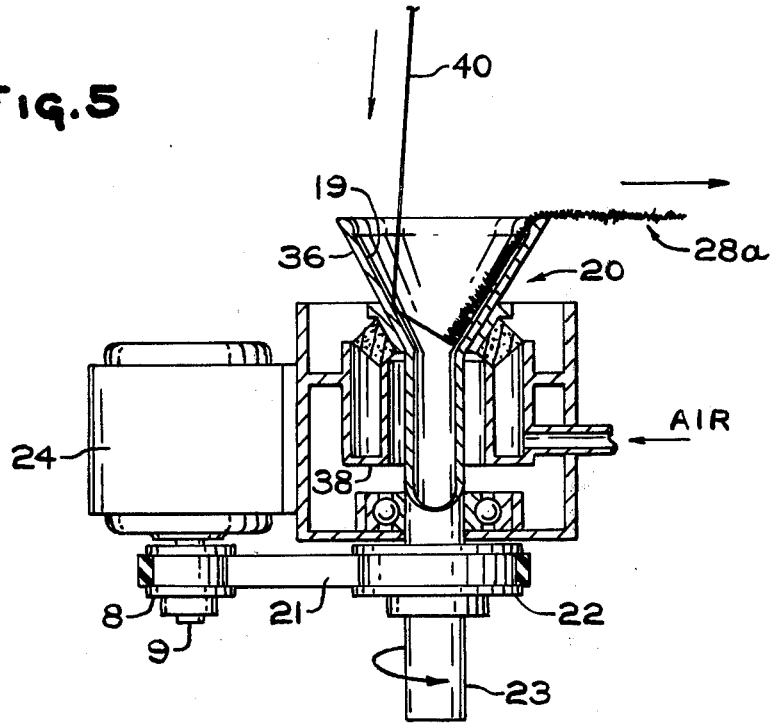
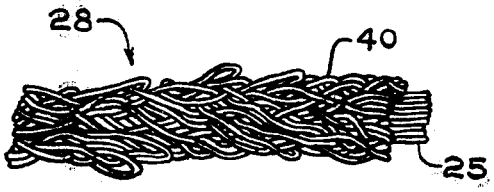
FIG. 6
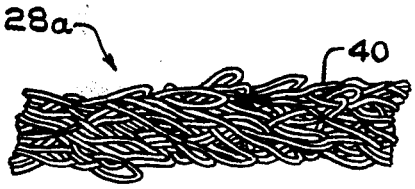
FIG. 7

BULKY YARN

CROSS-REFERENCE TO RELATED APPLICATIONS

This is a continuation-in-part of application Ser. No. 569,326 filed Apr. 17, 1975 now abandoned, which is a division of application Ser No. 452,106 filed Mar. 18, 1974, now U.S. Pat. No. 3,918,244.

BACKGROUND OF THE INVENTION

This invention relates to novel bulky yarn, and especially bulky yarns formed of glass filaments.

Bulky yarns, composed of fibrous material, are yarns whose bulk density is substantially less than the actual density of the materials present in the yarn itself. Bulky yarns are characterized by their fluffy appearance and high degree of resilience. Because of the novel characteristics of bulky yarns, textile manufacturers and fabricators have utilized bulky yarns for a plurality of textile products requiring low bulk density, such as wearing apparel, certain types of draperies, carpeting and the like.

The producers of glass fibers are particularly interested in bulky yarns due to their bulk density characteristics. Normally, glass fibers are heavier than those produced from other synthetic and natural fibers due to their inherent high bulk density and thus the utility of glass textile fibers is limited to applications where high bulk density textiles are tolerable. Bulky fiber glass yarns which have a substantially lower bulk density render glass fiber yarns useful for products not previously feasible with non-bulky glass fiber yarn. In addition, multiple composition bulky glass yarns have been of interest to textile manufacturers due to the possibility of varying physical properties of fabrics made from such yarns. Multi-composition yarns are formed by wrapping a yarn of one composition about a yarn of a different composition while bulking according to these methods is known to skilled textile manufacturers. A multitude of techniques have been used to bulk yarns of fiber glass and organic fibers, all of which require time consuming processes. The predominate general method of producing bulky yarn consists of forming protuberances by means of combining two yarns; hence, by wrapping an effect yarn in helical fashion about a core yarn and thereafter wrapping another yarn about the core and effect yarns to prevent slippage of the protuberances on the core yarn. A bulky yarn having a pseudo-twist is formed by this process. Another process for producing bulky yarn involves impinging high velocity air on the fibers in a strand by means of a bulking jet. In this system, gas turbulence bulks the strand by separating the filaments in the yarn. After the separation of filaments, a binder is typically applied to the yarn to provide permanence to the filament separation. The aforementioned methods of forming bulky yarn are more fully disclosed in U.S. Pat Nos. 3,675,368 and 3,253,396. These are exemplary of the art, it being understood that many other processes and modifications of these processes are available to the art.

The practice of the instant invention provides a bulky yarn having a low bulk density. Further, the invention provides a continuous fiber yarn having the appearance of a spun staple fiber yarn.

In addition, the present invention provides a bulky yarn with or without a core strand within the bulked yarn.

The aforementioned advantages and characteristics of the invention will become more evident from the following description.

SUMMARY OF THE INVENTION

The invention comprises attenuating a plurality of continuous fibrous filaments or groups of filaments at a high velocity while the filaments or groups of filaments are in essentially parallel relationship with respect to each other. The fibrous filaments or groups of filaments being attenuated at high velocity are then projected in a substantially straight line onto the interior surface of an inverted, rotating, trucated, open cone or into contact with a core yarn traveling through the cone. When the glass fiber filaments or groups of filaments contact the cone's interior surface, they are transformed into a plurality of connected loops. These loops tangle with each other and, if a core yarn is also employed, are wrapped about and tangled with the continuous fibrous strand core yarn, which is simultaneously being drawn through the open cone, in a direction approximately countercurrent to the travel path of the parallel fibrous filaments or groups of filaments.

If employed, a core strand travels through the cone at a velocity less than the velocity of the fibrous filament or groups of filaments. The bulky yarn thus formed is then collected by a suitable means such as a take-up reel or winder. The attenuation of the continuous fibrous filaments or groups of filaments can be accomplished by introducing the filaments or groups of filaments between at least two opposing flexible surfaces each moving in the same direction at substantially the same rate of speed, the flexible surfaces being engaged with one another during the movement thereof for a distance sufficient to impart a high velocity to the filament or groups of filaments engaged by the flexible surfaces. To release the filaments or groups of filaments from the flexible surface, one of the opposing flexible surfaces is moved away from the other flexible surface to permit the filaments or groups of filaments to remain in contact with the moving flexible surface, then abruptly changing the direction of movement of the flexible surfacing having the filaments or groups of filaments in contact therewith at a point on the flexible surface where the flexible surface and the filaments or groups of filaments are engaged until the direction of movement of the last flexible surface is at a sharp angle to the direction of movement of the filament or groups of filaments. Further elucidation of the apparatus and method of the aforementioned attenuation is disclosed in U.S. Pat. No. 3,293,013 which is incorporated herein by reference. However, the above-described method of attenuation is not intended as the sole means of attenuating the filaments or groups of filaments, Thus, wheel pullers and other methods may be used so long as the velocity of the filaments or groups of filaments can reach values of, for example, 5,000 to 20,000 feet per minute (1.524 to 6,096 meters per minute) or more and they can be maintained approximately parallel to each other.

When groups of filaments are employed, the natural grouping of the filaments from the glass fiber forming bushings is utilized. These natural groupings are usually determined by the construction of the bushing and apparatus associated therewith. The orifices in the bushing from which the filaments are formed are usually in groups of 5 to 50, thus providing a natural geometric grouping to the filaments which, in the case of the instant invention, is maintained until the fibers are released from the attenuator. Another natural grouping is by way of the cooling apparatus used to cool the filaments during formation. Cooling means, such as cooling fins, are placed proximate to the fiber forming bushing to reduce the temperature of the filaments during formation. The geometric positioning of the cooling provides a natural grouping to the filaments which is maintained in the instant invention until the filaments are released from the attenuator. These groupings usually contain about 5 to 50 filaments. However, the filaments may be ungrouped in the practice of the present invention, and, infact, this is often highly desirable. Further, filaments which were grouped during formation may be ungrouped before or during attenuation without adverse effects on the bulky yarn.

In a preferred embodiment, the inverted, truncated, open cone utilized in the process of the invention is what is known in the art as an open-end spindle. The open-end spindle is in fact an inverted, open, truncated cone supported by a bearing contacting the outer surface of the cone. The bearing is usually constructed of graphite in order that high speeds of rotation may be accomplished with minimum wear and heat build up. The truncated portion of the cone is conveniently fitted with a pulley permanently attached thereto and driven by a belt which is suitably connected to a motor armature to provide the rotation necessary to operate the spindle. While this arrangement forms a preferred embodiment for the cone and the drive system of the invention, other apparatus having a conical structure can be used provided the structure has a means for rotation at the speeds necessary to accomplish the desired effect. Typically, the speed of rotation of the open cone are in the order in 10,000 to 50,000 revolutions per minute, however, slower or faster speeds may be employed to produce yarn of a given bulk density and twist characteristics.

The continuous fibrous filaments or groups of filaments of the invention can be of a plurality of compositions. Both natural and synthetic fibers may be bulked in accordance with the bulking technique hereinafter described. The continuous filaments or groups of filaments utilized in the process may be composed of mineral fibers, such as glass, quartz and the like; natural fibers such as silk, cotton, wool and the like; synthetic fibers, such as nylon, Orlon, Saran, acetate rayon and the like or semi-synthetic fibers such as aralac, Ardil, vicara and the like. The only limitation on the type and composition of continuous fibrous filaments or groups of filaments used in the invention is that they be continuous and they be fibers.

The source of the filaments or groups of filaments can be a plurality of forming packages or bobbins each containing a continuous filament or groups of filaments or, in the case of synthetic and half synthetic fibers, the source can be the spinneret from the fibers are formed. When glass fibers are to be used as the fibrous filaments or groups of filaments in the practice of the invention, their source can be the bushing from which the glass fibers are formed. After the glass fibers are formed, but before they are contacted with any additional apparatus, the filaments or groups of filaments are lubricated by means of a binder and/or size to prevent breaking of the filaments due to abrasion against each other in contact with processing apparatus. Suitable lubrication can be provided by applying water, wax emulsion, silicone coupling agents or other lubricants known to manufacturers of glass fibers.

The binder and/or size may also contain other compounds such as starch, silicone resin and/or organic resinous materials to provide the fibers with diability properties and other desirable characteristics. The sizes may be used only with glass fibers, but also with the organic fibers to provide desired properties.

Filaments or groups of filaments are preferably passed through a ribbonizier which places the filaments or groups of filaments in approximately parallel relationship to each other, as a fibrous ribbon, prior to introduction of filaments or groups of filaments into the attenuator. Thus, the ribbonizer functions as a device to allow the filaments or groups of filaments to remain separate from each other as a ribbon prior to being formed into the bulky yarn. If a fibrous strand core yarn is employed, the core yarn is formed from a plurality of either continuous filaments or staple fibers formed into a continuous strand or yarn. The continuous fiber strand core yarn can be composed of virtually any composition limited only by the fact that it be fibrous and continuous. Examples of such fibers are cotton, flax, hemp, wool, hair, silk, glass, nylon, acetate rayon, rayon, aralac, Ardil, vicara, Saran, cellulose acetate rayon, asbestos and the like. The strand may also have deposited thereon a sizing composition as hereinbefore discussed.

As will be appreciated, using mixtures of strands and filaments or groups of filaments, bulky yarns can be formed having diverse compositions such as in instances where the continuous fibrous filaments are of one chemical composition and the continuous fibrous filaments is of a different composition. Also, the continuous fibrous filaments or groups of filaments can be of diverse chemical compsition, thus, bulky yarns having a great variety of chemical and physical properties can be produced by the practice of the present invention.

The bulkiness of the yarn can be regulated by variations in the filament velocity, cone velocity and, if employed, strand core yarn velocity. Thus, for example, by increasing the velocity of the filaments or groups of filaments over a given velocity in relation to a fixed velocity of the strand, bulkier yarn can be produced than at the given velocity in relation to a fixed velocity of the strand core yarn. Similarly, varying the strand core yarn velocity passing through the cone in relation to a fixed filament velocity will vary the bulk of the yarn obtained. Variations in the cone speed will vary the number of twists per inch of core yarn. Of course, if no core yarn is employed, the bulkiness of the yarn can be regulated by variations in the filament velocity, and cone velocity variations will vary the twists per inch of the yarn produced.

The collecting device used in the practice of the invention can be a winder which is merely a rotating drum on which the bulky yarn is collected. Other means known to the art can also be used to collect the product of the invention. When the continuous fibrous filaments or groups of filaments contact the surface of the inverted, rotating cone or the strand passing therethrough, they are travelling at such a velocity as to displace the fibrous filaments or groups of filaments into a random disorderly array of a plurality of connected loops while simultaneously tangling the loops with each other and wrapping them about and entangling them with the core yarn passing through the cone, if the core yarn is employed. Thus, the filaments or groups of filaments are permanently entangled with each other and optionally wrapped about and entangled with the travelling strand giving the bulky characteristics of the yarn produced. The bulky yarn thus formed is then wound on a collecting device which may also serve as the means which draws the strand core yarn through the open cone. The resultant package of bulky yarn formed in the manner of the invention can then be further processed and fabricated into products and articles useful for many standard yarn purposes.

When glass fibers are used in the practice of the invention, after the bulky yarn is produced, it can be heat set. Heat setting entails heating the yarn to 800° to 1000°F. (426.7° to 537.8° C.) which permanently sets the tangles and the wrapping of the filaments about the core strand, if employed. Also, heat setting maintains the slight crimps present in the fibers composing the yarn.

To facilitate the tenacity of the bond between the strand core yarn and the filaments or groups of filaments wrapped and tangled thereabout, an adhesive composition may be applied to the strand core yarn. This adhesive is preferred to be applied to the strand at a time immediately preceeding the entrance of the strand and core yarn into the open cone. However, the adhesive may be applied after the bulky yarn is formed or during formation. This adhesive can be any organic material which provides the resilient adhesive characteristics to improve the bond between the filaments and the strand core yarn such as polyvinyl acetate latex adhesive, gelatinous adhesive, polyester hot melt adhesives and the like.

BRIEF DESCRIPTION OF THE DRAWINGS

FIG. 3 is an enlarged elevational view of the attenuator used in the embodiments of FIGS. 1 and 2 of the present invention.

FIG. 4 is an enlarged elevational view partially in section of the inverted open cone of FIG. 1 illustrating tangling and wrapping of the continuous filaments or groups of filaments with a core strand.

FIG. 5 is an enlarged elevational view partly in section of the inverted open cone of FIG. 2 illustrating the entangling of the continuous filaments or groups of filaments alone to form a bulky yarn.

FIG. 6 is a view of the bulky strand produced by the present invention including a core.

FIG. 7 is a view of the bulky strand produced by the present invention employing only the ribbon of filaments or groups of filaments.

DETAILED DESCRIPTION OF THE DRAWINGS

Figure 1:
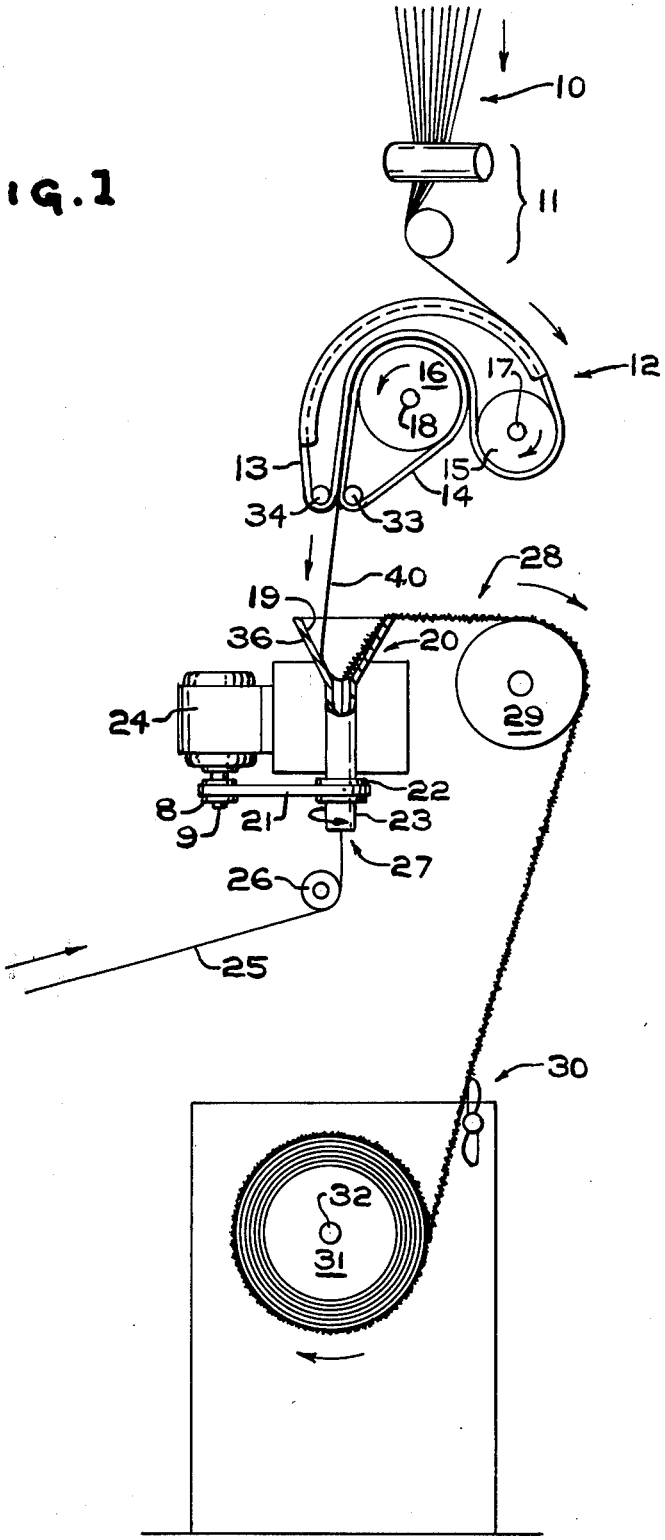
FIG. 1 is an elevational view partly in section of one form of the apparatus of the present invention, to form a bulky yarn including a core.

In the various figures, the same reference characters are used to refer to the same parts.

Figure 2:
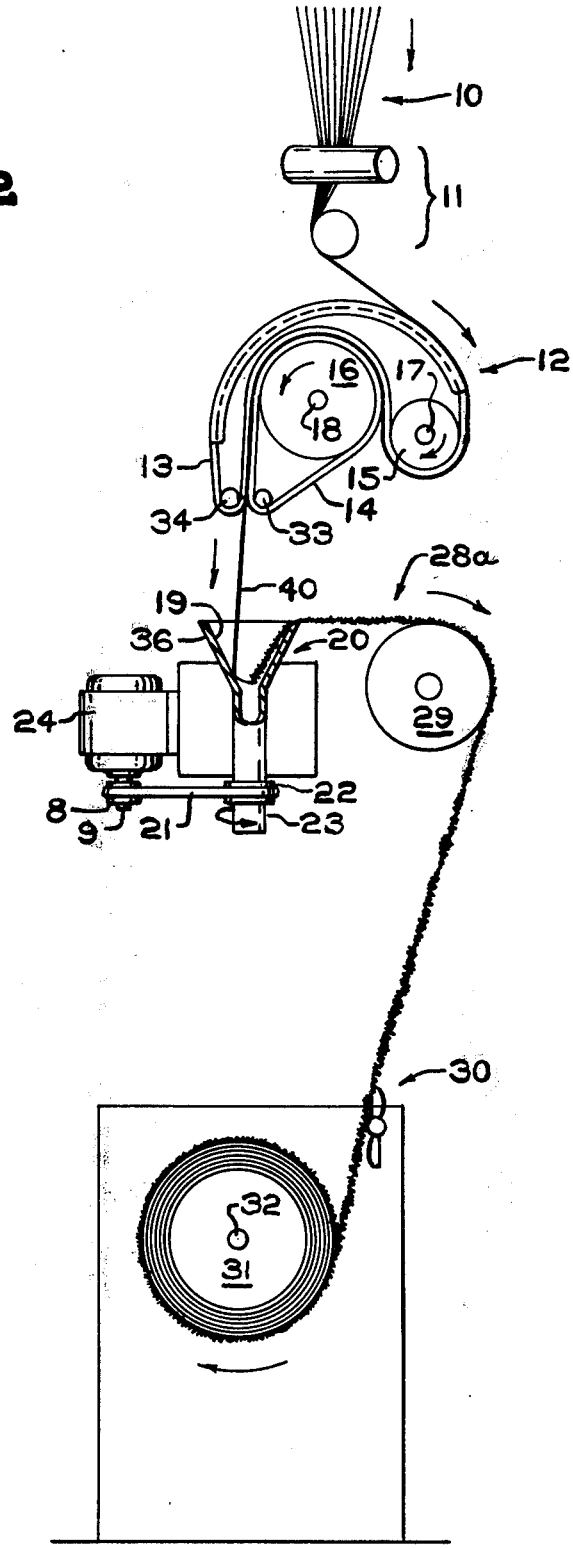
FIG. 2 is an elevational view partly in section of another form of the apparatus of the present invention, in which a bulky yarn is formed only of a ribbon of continuous filaments or groups of filaments.

Turning now to FIGS. 1 and 2, filaments or groups of filaments 10 are shown being passed over a ribbonizier 11 which aligns the filaments 10 into approximately parallel relationship with respect to each other prior to their being fed into the attenuator, generally designated by the numeral 12. In the attenuator 12, the approximately parallel filaments or groups of filaments, now designated as 40, are drawn around the belt 13 while still in parallel relationships, and are passed between the belts 13 and 14. Belts 13 and 14 are driven by pulleys 15 and 16 connected through the shafts 17 and 18, respectively. Shaft 18 is driven by a motor (not shown). The pulleys 15 and 16 drive the belts 13 and 14 at a radial velocity sufficient to propel the filaments 40 in parallel when the belts are reflexed over the pins 33 and 34 into a space at the velocity preferably from about 5,000 to 20,000 feet per minute (1524 to 6096 meters per minute). The filaments 40 are impinged upon the interior surface 19 of a rotatable, inverted open cone 20. In this embodiment of the invention the rotatable inverted open cone 20 is shown as an open-end spindel, as known in the art. The open-end spindel 20, operating at preferably about 10,000 to 50,000 revolutions per minute, is driven by means of a belt 21 in riding contact with a pulley 22 which is fixedly mounted to the shaft 23 of the open-end spindel 20. The open-end spindel 20 is rotationally driven by the electric motor 24 at the aforementioned velocity with armature 9 and the pulley 8 fixedly mounted thereto. Thus, belt 21 rides on a pulley 8 and pulley 22. As the attenuated filaments or groups of filaments 40 impinge on the surface of the inverted cone 19 or strand core yarn 25, the filaments are displaced from their parallel form and are scattered into disarray as a plurality of connected loops within the open cone 20.

As can be seen in FIG. 1, the loops of continuous filaments 40 are tangled with each other and continuously wrapped and tangled about the strand 25 which is travelling vertically through the cone 20. Wrapping of the tangled filaments 40 about the strand 25 results in applying a twist to the yarn 28. The strand core yarn 25 is travelling at a velocity of preferably about 200 to 2,000 feet per minute (609.6 to 6096 meters per minute) as it passes through the cone 20. The velocity of both the filaments 40 and the strand core yarn 25 may be adjusted to produce a variety of desired bulking characteristics and twists.

The continuous strand core yarn 25 is drawn from a source, not shown, such as a creel or a bobbin, over a guide rail 26 which guides the strand core yarn 25 through the aperture 27 of the open-end spindel 20. After the bulky yarn 28 is formed, it is passed over a idler 29 which aids in the collection of the bulky yarn product. After passing over the idler 29, the bulky yarn 28 in contacted with a traverse 30, said traverse aiding the winding of the bulky yarn in random patterns on a rotating drum 31. The rotating drum 31 is driven by a shaft 32 connected to a suitable motor. The rotating drum 31 is driven at a velocity adequate to draw the strand core yarn 25 through the cone 20 at the desired speed.

In FIG. 2, the parallel filaments or groups of filaments 40 which form a plurality of connected loops within the inverted, truncated open cone 20 are shown as they form the plurality of connected loops which entangle with each other to form a bulky yarn without the necessity of a core. The collection of the bulky yarn 28a is identical to that of FIG. 1, with the rotating drum 31 rotating at a speed less than the speed that the filaments 40 through the attenuator to aid in the bulking of the yarn.

Turning now to FIG. 3, there is shown an enlarged view of the attenuator 12 of FIGS. 1 and 2 propelling the filaments or groups of filaments 40 into space. As shown therein, the belt 13 passes over the pulley 15 on the shaft 17. The idler is driven by the belt 13 which is driven by contacting the belt 14. The belt 13 passes around the back end and bottom of the drive pulley 15 and is contacted with the second belt 14 which is rotating on the pulley 16 which is driven by a shaft 18, connected to a motor (not shown). The filaments 40, approximately parallel to each other, are drawn between the surfaces of the two belts 13 and 14 to impart velocity to the filaments. The stationary pins 33 and 34 provide a pivot on which the belts are separated and the filaments 10 are propelled into space. The air bushing 35 supports and guides the belt 33 directing the travel thereof.

Turning to FIG. 4, there is shown a large view, partially in section, of the spinning device 20 with the bulky yarn including a core being formed therein. FIG. 4 shows the strand core yarn 55 being drawn from a source (not shown) around the free wheeling guide roll 26. The strand is then passed through the aperture 27 of the open-end cone being driven by the belt 21 which is contacted to the open-end spindel 20 by means of the pulley 22. The pulley 22 is permanently attached to the shaft 23, and the belt 21, i.e., shown driven by the motor 24 by the armature 9 and associated pulley 8.

The exterior surface of the cone generally designated as 36 is in contact with a bearing 37 which, in this embodiment, is of graphite construction having an anular plenum chamber 38 to which air is introduced under pressure. The air graphite bearing 37 has a low coefficient of friction so that the open-end spindel 20 rotates the filaments 40, forming them into a plurality of connected loops as they are being impinged upon the interior surface 19 of the open-end spindel prior to being wrapped and tangled about the strand core yarn 25.

In FIG. 5, the spinning device 20 with the bulky yarn 28*a* formed of a plurality of continuous filaments or groups of filaments 40 is shown. In this embodiment, the inner surface 19 of the roatating cone 20 combines filaments 40 into a plurality of connected loops which entangle with each other to form the bulky yarn.

FIG. 6 illustrates the bulky yarn formed by the embodiment of FIG. 1. The yarn comprises a core 25 which has wrapped about it and tangled therewith a plurality of connected loops of the continuous filaments or groups of filaments 40. These loops are also tangled with each other to further add to the bulk characteristics of the yarn 28. While being formed entirely of continuous filaments, the yarn has the appearance of a spun staple yarn, with the plurality of entangled loops having the appearance of a plurality of entangled staple length fibers.

FIG. 7 illustrates the bulky yarn 28*a* formed in the embodiment of FIG. 2. In this embodiment, the plurality of continuous loops of continuous filaments or groups of filaments 40 are entangled with each other to form the bulky yarn. This yarn, too, has the appearance of a spun staple fiber yarn, with the plurality of connected loops giving the appearance of a plurality of spun staple length fibers.

Figure 8:
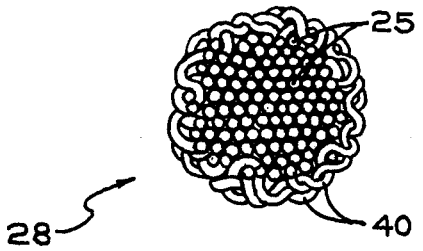
FIG. 8 is an expanded cross-sectional view of the bulky strand of FIG. 6, illustrating the entanglement of the loops with the core.

FIG. 8 is an expanded cross-sectional view of the bulky strand 28 of FIG. 6. The loops 40 are entangled with each other and wrapped about and entangled with the core 25.

While the invention has been described with reference to certain illustrative embodiment, it is not intended that the instant invention be limited thereby, except insofar as appears in the accompanying claims.

I claim:

1. A twisted, low bulk density yarn having the appearance of a spun staple fiber yarn comprising a continuous strand core and a plurality of connected loops of continuous filaments or groups of filaments, said loops being entangled with each other and wrapped about and entangled with said strand core, to provide a bulky yarn.

2. The yarn of claim 1 wherein said strand core is a glass strand.

3. The yarn of claim 1 wherein said filaments or groups of filaments are glass filaments.

4. The yarn of claim 1 wherein said strand core is a glass strand and said continuous filaments or groups of filaments are glass filaments.

* * * * *